United States Patent [19]

Kurtz et al.

[11] 4,198,270

[45] Apr. 15, 1980

[54] HEAD BOX FOR A PAPER MAKING MACHINE

[75] Inventors: Rudiger Kurtz, Immenstaad; Christoph Link, Ravensburg; Wolfgang Trudel, Bad Waldsee; Siegfried Reutter, Gerbertshaus, all of Fed. Rep. of Germany

[73] Assignee: Sulzer Brothers Ltd., Winterthur, Switzerland

[21] Appl. No.: 908,691

[22] Filed: May 23, 1978 (Under 37 CFR 1.47)

[30] Foreign Application Priority Data

May 23, 1977 [CH] Switzerland ..... 006311/77

[51] Int. Cl.[2] ..... D21F 1/02; D21F 1/06

[52] U.S. Cl. ..... 162/343; 162/216

[58] Field of Search ..... 162/343, 216

[56] References Cited

U.S. PATENT DOCUMENTS

| | | | |
|---|---|---|---|
| 3,385,754 | 5/1968 | Burgess, Jr. | 162/343 X |
| 3,769,155 | 10/1975 | Schiel | 162/343 |
| 3,909,349 | 9/1975 | Stotz et al. | 162/343 X |
| 3,962,031 | 6/1976 | Bubik et al. | 162/343 X |
| 4,070,238 | 1/1978 | Wahren | 162/343 |

*Primary Examiner*—Richard V. Fisher

*Attorney, Agent, or Firm*—Kenyon & Kenyon

[57] ABSTRACT

The head box has a plurality of distribution pipes for delivering pulp with each distribution pipe communicating via a plurality of feed pipes with a row of flow ducts in a block having a plurality of rows of flow ducts. The feed pipes have equal flow resistance and each has a pin-shaped part at the inlet end which acts to anchor the feed pipe in place. Each pin-shaped part also carries a cam which projects into a distribution pipe to keep the inlet to the respective feed pipe free of fibers.

8 Claims, 4 Drawing Figures

HEAD BOX FOR A PAPER MAKING MACHINE

This invention relates to a head box for a paper making machine.

As is known, head boxes have been constructed with a guide assembly in the form of a block in which stepped parallel flow ducts are formed for delivery of individual streams of pulp to a converging channel which terminates in an exit slot or throat. Such constructions, as is known from U.S. Pat. No. 3,725,197, usually produce an intense turbulence at the stepped widenings of the flow ducts to obtain a uniform distribution of the suspended particles in the suspension supplied for paper production. Generally, in order to feed pulp to the flow ducts in the block, use is made of a tapering distribution pipe which connects to the block transversely of the flow ducts so as to simultaneously feed all the flow ducts to obtain a generally uniform distribution of the pulp among the flow ducts.

As described in Austrian Patent No. 323,546 (U.S. Pat. No. 3,909,349), the distribution pipe may have a rectangular cross section. However, the plane surfaces of such a pipe must be greatly reinforced with fins—where the paper making machine is a high speed machine which operates with pulp at high pressures. This results in a relatively expensive and heavy construction.

Also, as described in U.S. Pat. No. 4,087,321, the distribution pipe may be conical with a lateral slit with which the pipe is connected to the guide assembly. Although such a pipe may have relatively thin walls, the construction is relatively expensive because of the required size of the pipe and the support structure for the pipe.

Accordingly, it is an object of the invention to provide a relatively simple and light weight construction for feeding pulp to a guide assembly of a head box.

It is another object of the invention to provide a construction for feeding pulp to a guide assembly of a head box which can be easily fabricated.

It is another object of the invention to provide a head box which can be used to make laminated paper.

Briefly, the invention provides a head box which includes a guide assembly in the form of a block having a plurality of flow ducts for the flow of pulp which are arranged in rows and a feeding means for feeding pulp to the flow ducts which includes a plurality of distributing pipes for conveying individual flows of pulp. Each distribution pipe has a cross-section of decreasing cross-sectional area in the direction of pulp flow. Further, the feeding means has a plurality of feed pipes interconnected to each respective distribution pipe. Also, each feed pipe is interconnected between a respective distribution pipe and a respective one of the flow ducts of a respective row of flow ducts in the guide assembly block.

The flow ducts in the block are each provided with a stepped widening relative to the direction of pulp flow to impart turbulence, as is known.

The head box also has a means defining a converging channel extending from the block downstream of the flow of pulp which terminates in an exit slot or throat parallel to the rows of the flow ducts.

Because of the construction of the head box, it is possible to subdivide the distributing pipe which has a large cross section and thick walls, into a number of smaller pipes which can have correspondingly smaller cross sections and thus also thinner walls. The manufacture and the assembly of these small distributing pipes is thus considerably facilitated. In addition, the head box has the advantage that pulp fluid of a different composition and quality can be fed to the individual distributing pipes, each of which is connected to a row of the guide channels. This permits the manufacture of laminated paper which contains layers of different properties in a simple manner.

Tests have shown that in a head box with a guide assembly whose flow ducts have exclusively stepped widenings, a layering formed by the individual currents in the flow ducts is preserved in the converging channel, particularly when flow ducts of minimum wall thickness are arranged in super-position after the last stepped widening. These channels can be bonded, for example, by thin honey-comb plates.

Preferably, the distribution pipes associated with the individual rows of the flow ducts can be arranged with the feed pipes spread out in fan-fashion. The feed pipes can all have the same flow resistances for the pulp fluid. In such an arrangement, where the lengths of the feed pipes do not differ greatly from each other, it suffices to maintain the same pressure of the pulp fluid in all the distributing pipes to obtain equal and uniform flow conditions in all flow ducts and, thus, also in the converging channel.

The distributing pipes can be secured on a support frame which, in turn, is secured on a guide assembly produced from a metal block. In this way, a particularly compact and light-weight construction is achieved with good accessibility to all parts.

The feed pipes and the distributing pipes can have substantially round cross sections, the feed pipes being connected radially to the distributing pipes. The round cross-section permits a favorable pressure load of the pipes, so that they can have thin walls and be light-weight. If necessary, they can be made of a flexible material of low strength. The radial extension of the pipes ensures the same inflow conditions in all pipes, which facilitates the equalization of the flow resistances of the feed pipes.

The inlet ends of the feed pipes can also be provided with pin-shaped parts, each of which has a bore or opening whose diameter is smaller than the inside diameter of the feed pipes. The parts serve not only as an inner support of the end of the feed pipes, which facilitates the mounting of the feed pipes, but also enhances the turbulence of the pulp fluid and, thus, the homogenization of the suspension by forming another stepped widening, at the transition from the opening of the inside diameter to the inside diameter of the pipe.

The supporting parts can be provided with cams which precede the openings in the direction of flow in the distributing pipe, rise in the direction of flow, and terminate in the range of the opening in a surface which is substantially parallel to the axis of the opening. The cams prevent the accumulation of paper fibers at the approach rims of the openings and thus the risk of flocculation. These and other advantages of the invention will become more apparent from the following description taken in conjunction with the following drawing in which.

Figure 1:
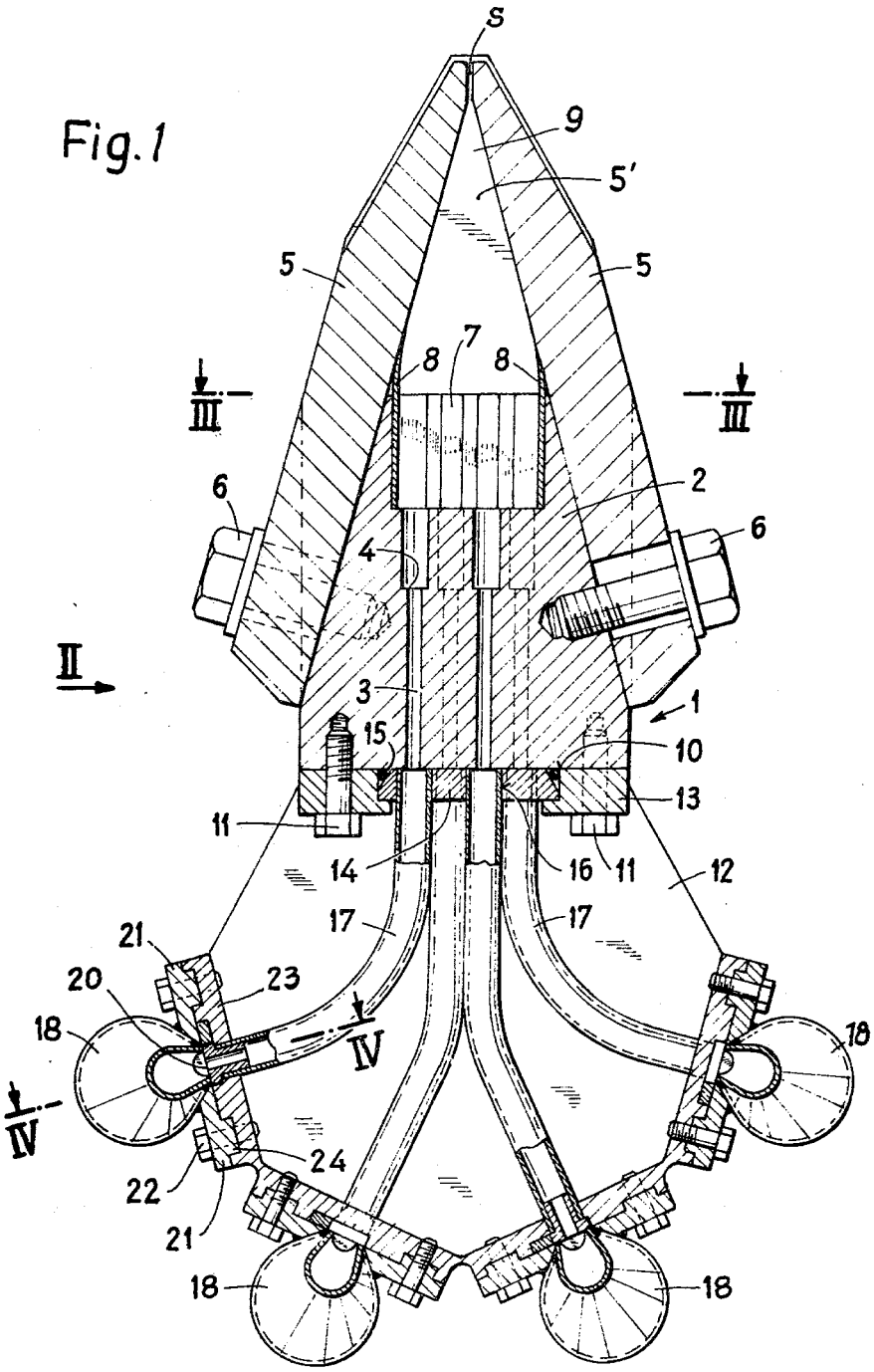
FIG. 1 illustrates section of a head box according to the invention.
Figure 2:
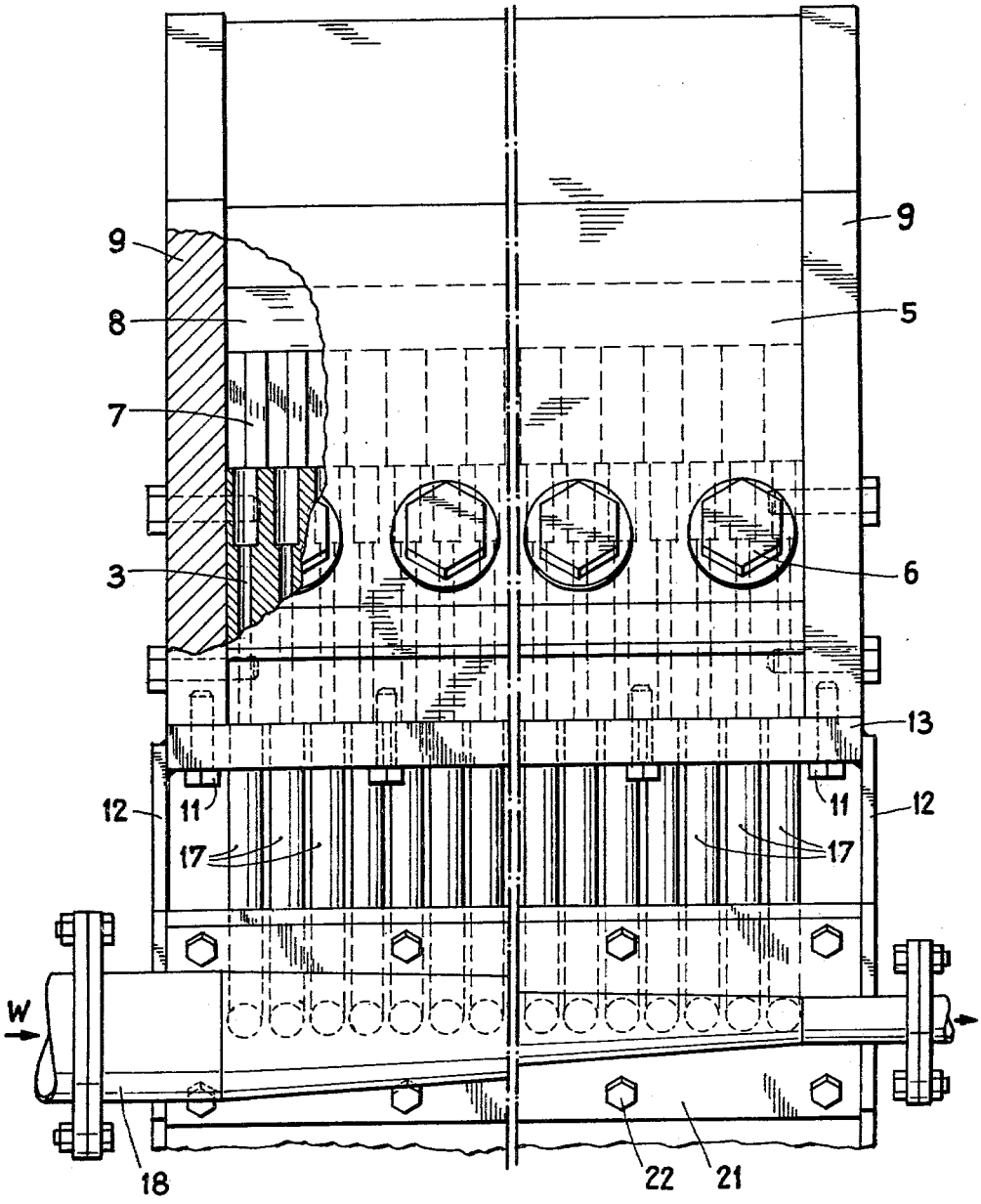
FIG. 2 illustrates a partial view with a partial section corresponding to the viewing direction along arrow II in FIG. 1.

Referring to FIGS. 1 and 2, the head box contains a guide assembly 1 consisting of a metal block 2 in which are formed flow ducts 3 with stepped widenings 4. In addition, means are mounted on the block 2 in the form of inclined plates 5 which define with each other a conveying channel and an exist slot or throat for the pulp fluid. The plates 5 are secured in the block 2 by screws 6 and are adjustable after the screws 6 have been loosened. At the ends, the converging channel 5' formed by the plates 5 is bonded by end walls 9.

In the represented embodiment the flow ducts 3 are arranged parallel to each other. However, the flow ducts 3 may also be inclined and directed with their axes e.g. toward the exit slot S.

Figure 3:
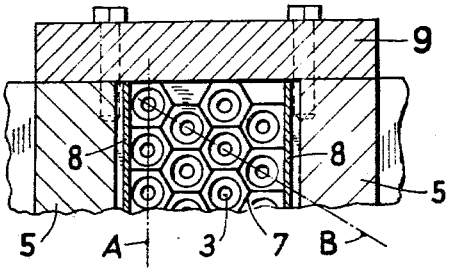
FIG. 3 illustrates a partial section taken along line III—III in FIG. 1.

As shown particularly in FIG. 3, the flow ducts 3 are arranged in rows A and in columns B. The rows A extend parallel to the slot S with column B transverse thereto.

As shown in FIGS. 1 and 3, the flow ducts 3 of the block 2 are adjoined by a guide part 7 which consists of thin plates forming honeyweb channels. This guide part 7 is adjoined laterally by cover plates 8 which cover the angular space between the block 2 and plates 5.

A support frame 12 is secured via bolts 11 on the bottom end face 10 of the guide assembly 1. This support frame 12 has two parallel strips 13 for passage of the bolts 11. The strips 13 also retain a perforated plate 14 whose edges are sealed from the strips 13 by seals 15. The perforated plate 14 is provided with openings 16, each of which is coaxial to a flow duct 3.

The head box also has a feeding means for feeding pulp to the flow ducts 3. This feeding means includes a plurality of distributing pipes 18 for conveying individual flows of pulps. These pipes 18 are mounted about the support frame 12 in fan-fashion i.e. the distributing pipes 18 and the connecting pipes 17 are arranged essentially in a radiating manner about a common center. Also, each pipe 18 has a crosssection of decreasing cross-sectional area in the direction of pulp flow W (FIG. 2). For example, the distributing pipes 18 are conical with a substantially round cross section. Each pipe 18 also has an exit slot 20 (FIG. 1) at one side at the edges of which are arranged fastening plates 21. The fastening plates 21 are secured by bolts 22 on supporting plates 23 of the support frame 12. In order to absorb the tangential forces of the distributing pipes 18, which try to widen the slots 20, a tongue and groove arrangement 24 is provided between the fastening plates 21 and supporting plates 23.

In addition, the feeding means has a plurality of feed pipes 17 interconnected to each distribution pipe 18. Each feed pipe 17 is connected between a distribution pipe 18 and a respective flow duct 3 of a given row A.

As shown in FIG. 1, the pipes 17, which are associated with a row A of the flow ducts 3 are connected to a common distributing pipe 18. There are thus as many distributing pipes 18 provided as there are rows A of the flow ducts 3. The feed pipes 17 all have the same flow resistances for the pulp fluid. This means that pipes 17 with greater curvatures have a smaller length than those with lesser curvatures or straight pipes, for example, which are not shown here.

Figure 4:
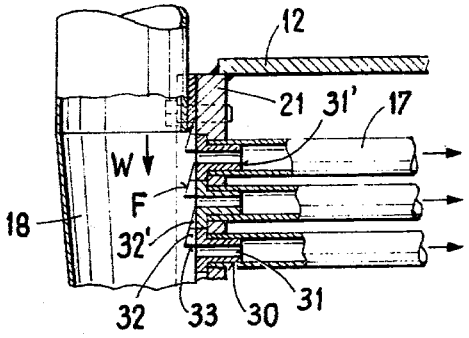
FIG. 4 illustrates a partial section taken along line IV—IV in FIG. 1.

Referring to FIG. 4 the inlet ends of the feed pipes 17 are provided with pin-shaped parts 30 with bores 31. The parts 30 serve to reinforce the ends of the pipe 17 when they are fastened on the fasteneing plates 21 in which the feed pipes are mounted. Also a stepped widening 31' is formed between the bore 31 of a supporting part 30 and the inside diameter of a feed pipe 17 which causes a similar turbulence of the pulp fluid as the widenings in the flow ducts 3.

In addition, the supporting parts 30 are provided with cams 32, 32' which procede the bores 31 in the direction of flow W in the distributing pipe 18. The cams 32, 32' rise in the direction of flow W and terminate in the range of the bore 31 in a surface 33 extending substantially parallel to the axis of the bore 31.

As shown, the cams 32 and 32' are formed on adjacent edges of supporting parts 30 and form a common surface F. However, the cams, in this case cams 32, can be formed on one side of the supporting part only, that is, cam parts 32' can be eliminated, if a steeper rise of the cams and a lesser height are acceptable.

The cams 32, 32' serve to prevent the adhesion of paper fibers on the rims of the bores 31, which could lead to undesired lump formation, by causing turbulence in the flow of the pulp fluid during deflection of the flow from the distributing pipe 18 into the bores 31.

The embodiments of the invention in which an exclusive property or privilege is claimed are defined as follows:

1. A head box comprising a block having a plurality of parallel flow ducts passing therethrough for the flow of pulp, each said flow duct having a stepped widening therein relative to the direction of pulp flow, said flow ducts being disposed in a plurality of parallel rows;

means defining a conveying channel extending from said block downstream of the flow of pulp and terminating in an exit slot parallel to said rows of flow ducts; and a feeding means for feeding pulp to said flow ducts in said block, said feedng means including a plurality of distributing pipes for conveying individual flows of pulp, each said pipe having a cross-section of decreasing cross-sectional area in the direction of flow of pulp therethrough, and a plurality of feed pipes interconnected to each respective distribution pipe, each said feed pipe being interconnected between a respective distribution pipe and a respective one of said flow ducts of a respective row of flow ducts in said block.

2. A head box as set forth in claim 1 wherein said distributing pipes and said feed pipes are spread out in fan fashion.

3. A head box as set forth in claim 2 which further comprises a support frame secured to said block, said support frame having said distributing pipes mounted thereon.

4. A head box as set forth in claim 1 wherein said feed pipes have equal flow resistance for the pulp flows.

5. A head box as set forth in claim 1 wherein said feed pipes are radially connected to a respective distribution pipe, and wher in said feed pipes and distribution pipes have round flow cross-sections.

6. A head box as set forth in claim 1 which further comprises a plurality of pin-shaped parts, each part being inserted in an upstream end of a respective feed pipe to reinforce said end and having a cylindrical bore of a diameter less than the inside diameter of said feed pipe.

7. A head box as set forth in claim 6 wherein each part has a cam projecting into a respective distribution pipe upstream of said bore thereof, each cam being of increasing height in the direction of pulp flow in said distribution pipe and terminating with a surface substantially parallel to the axis of said bore.

8. A head box as set forth in claim 1 wherein the number of distributing pipes is equal to the number of rows of said flow ducts.

* * * * *

UNITED STATES PATENT AND TRADEMARK OFFICE

CERTIFICATE OF CORRECTION

PATENT NO. : 4,198,270

DATED : April 15, 1980

INVENTOR(S) : Rudiger P. Kurtz, Et Al

It is certified that error appears in the above—identified patent and that said Letters Patent is hereby corrected as shown below:

Column 1, lines 49 & 50, change "cros-ssectional" to --cross-sectional--

Column 1, line 63, delete second occurrence of "the"

Column 3, line 42, change "crosssection" to --cross-section--

Column 4, line 9, change "procede" to --precede--

Signed and Sealed this

*Nineteenth* Day of *August 1980*

[SEAL]

*Attest:*

SIDNEY A. DIAMOND

*Attesting Officer*

*Commissioner of Patents and Trademarks*